US005940881A

United States Patent [19]

Murphy

[11] Patent Number: 5,940,881

[45] Date of Patent: Aug. 24, 1999

[54] APPARATUS FOR PROTECTING A LIMB OF A USER

[76] Inventor: Theresa Ann Murphy, 3116 Ninth St., NW., Albuquerque, N.Mex. 87107

[21] Appl. No.: 09/128,245

[22] Filed: Aug. 3, 1998

[51] Int. Cl.[6] ..... A41D 13/08

[52] U.S. Cl. ..... 2/16; 2/22; 2/59; 2/125; 2/231

[58] Field of Search ..... 2/50, 51, 59, 125, 2/126, 227, 231, 242, 269, 270, 22, 16

[56] References Cited

U.S. PATENT DOCUMENTS

| | | | |
|---|---|---|---|
| 1,654,452 | 12/1927 | Bradley | 2/23 |
| 1,777,620 | 10/1930 | Modesitt | 2/231 |
| 2,326,422 | 8/1943 | Weisberger | 2/59 |
| 2,751,595 | 6/1956 | Patraw et al. | 2/59 |
| 3,593,803 | 7/1971 | Ibach | 173/370 |
| 3,657,741 | 4/1972 | Blanco | 2/59 |
| 4,561,121 | 12/1985 | Ehring et al. | 2/227 |
| 4,856,112 | 8/1989 | Effle | 2/59 |
| 4,920,577 | 5/1990 | Scharf | 2/23 |
| 4,987,613 | 1/1991 | Loverdi et al. | 2/23 |
| 5,038,408 | 8/1991 | DeBaene | 2/51 |
| 5,159,720 | 11/1992 | Scott, Jr. | 2/171 |
| 5,173,967 | 12/1992 | Carter | 2/242 |
| 5,357,633 | 10/1994 | Rael | 2/59 |
| 5,402,536 | 4/1995 | Matthews | 2/59 |
| 5,452,478 | 9/1995 | Rombach et al. | 2/161.6 |
| 5,542,121 | 8/1996 | Lahaussois et al. | 2/59 |

*Primary Examiner*—Diana L. Oleksa
*Assistant Examiner*—Katherine Moran
*Attorney, Agent, or Firm*—Ray R. Regan

[57] ABSTRACT

An apparatus for protecting a limb of a user. The apparatus includes two or more anthropometrically shaped panels. Each panel is formed from sheets that are both flexible and stable to maintain the shape of the apparatus during use without need for additional elements to hold the shape of the apparatus. The panels are connected, preferably by sewing. The apparatus is worn by the user to avoid limb injuries.

10 Claims, 2 Drawing Sheets

APPARATUS FOR PROTECTING A LIMB OF A USER

CROSS-REFERENCE TO RELATED APPLICATION

None.

FEDERALLY SPONSORED RESEARCH AND DEVELOPMENT

None.

FIELD OF THE INVENTION

The present invention pertains generally to protection devices. More particularly, the present invention pertains to an apparatus for protecting a limb of a user. The present invention is particularly, but not exclusively, useful for protecting a limb of a user from abrasions, punctures and similar injuries.

BACKGROUND OF THE INVENTION

Throughout history, man has sought to provide apparatus for protecting limbs of bodies. The term "limb" or "limbs" generally refer to a part or member of an animal body, including the human body, distinct from the head. The present invention relates to an apparatus for protecting a limb of a human user which is particularly, but not exclusively, useful for protecting a limb of a user from abrasions, scratches, punctures, slivers, heat and cold injuries, ultraviolet and other undesirable rays of the sun, and similar injuries to a limb of a user of the apparatus (collectively, "limb injuries").

The present invention is useful for protecting a limb of a user from limb injuries when engaged in work in connection with trees, shrubs, bushes, hedges and other plant and tree materials, including but not limited to pruning and grafting. The present invention also is useful for protecting a limb of a user from limb injuries during walking, hiking, climbing or other activities conducted in and around forested, planted mountainous and rocky environments. The present invention also protects a limb from limb injuries associated with installing and maintaining metal, wood, and other materials, including but not limited to barbed wire, razor wire, and fence posts.

Unlike currently available apparatus for protecting limbs, the present invention has the remarkable feature of remaining in a substantially stable configuration when worn and used by the user. The term "stable configuration" refers to the ability of the apparatus to retain and hold its original shape when installed on a limb, and remain in that substantially stable configuration during use. Unlike other protective apparatus for limbs, the anthropometrically formed structure of the present invention will not fall, droop, or sag when installed on a limb, yet does not require additional structural elements to hold the apparatus in a substantially stable configuration. Currently available apparatus for protecting a limb often require metal or plastic snap fasteners, elastic strips, and similar additional elements to maintain a substantially stable configuration.

Available apparatus for protecting a limb also require use of heavy plastic materials, Plexiglas, Fiberglass, metal and similar materials, either alone or in conjunction with other materials, to enhance the limb injuries protection capabilities of the apparatus.

What is needed, therefore, is an apparatus for protecting a limb from limb injuries during use.

Also needed is an apparatus for protecting a limb of a user that retains a substantially stable configuration when worn and used by the user. An anthropometrically shaped apparatus for protecting a limb is needed that does not fall, droop, or sag when installed on a limb without requiring use of additional structural elements to hold the apparatus in a substantially stable configuration. In addition, an apparatus is needed for protecting a limb of a user from limb injuries that does not require use of metal or plastic snap fasteners, elastic strips, and the like, to maintain a substantially stable configuration of the apparatus, or to provide protection against limb injuries.

What also is needed is an apparatus for protecting a limb of a user that does not require use of heavy plastic materials, Plexiglas, and Fiberglass, or other materials to achieve protection of the user from limb injuries.

In light of the above, it is an object of the present invention to provide an apparatus for protecting a limb from limb injuries during use.

It also is an object of the present invention to provide an apparatus for protecting a limb of a user which retains a substantially stable configuration when worn and used by the user.

It is yet another object of the present invention to provide an apparatus that does not fall, droop, or sag when installed on a limb of a user, without using additional elements to hold the apparatus in a substantially stable configuration.

Yet another object of the present invention is to provide an apparatus for protecting a limb of a user from limb injuries that does not require use of metal, plastic or other materials in components of the apparatus to provide protection from limb injuries or to hold the apparatus in a substantially stable configuration.

Yet another object of the present invention is to provide an apparatus for protecting a limb of a user, and a method for making an apparatus for protecting a limb of a user which respectively are easy to use and to practice, and which are cost effective for their intended purposes.

These and other objects, features, and advantages of such an apparatus for protecting a limb of a user will become apparent to those skilled in the art when read in conjunction with the accompanying following detailed description, drawing figures, and appended claims.

SUMMARY OF THF INVENTION

An apparatus for protecting a limb of a user, according to the present invention, includes two or more anthropometrically formed panels. The term "anthropometrically" means that each panel is shaped substantially to the general size and proportion of a human limb to be protected by the apparatus. Each panel is formed of one or more sheets of material selected not only for the quality of the material to protect against limb injuries, but also for the capacity of the material to provide comfort to the user, and to hold shape and maintain a substantially stable configuration when installed on the limb of a user without the need for any other components, elements or structural enhancements to assist in maintaining the substantially stable configuration.

In one embodiment of the present invention, each of the two or more panels is constructed of a single sheet of material capable of maintaining a substantially stable configuration during use by a user. In that embodiment, the apparatus does not fall, droop, or sag when installed on a limb of a user, and retains a substantially stable configuration without using additional mechanical elements or material to hold the apparatus in a substantially stable configuration.

In another embodiment of the present invention, each of the two or more panels is formed of an outer sheet and a sheet comprising an inner pad. The term "outer" means a sheet located closest to anything which may cause a limb injury to the user. The term "pad" describes a sheet providing a cushion-like mass of material softer than the material used for the outer sheet for both comfort and protection of the user from limb injuries.

In a preferred embodiment of the present invention, the outer sheet is formed of a canvas material. The term "canvas" means a closely woven cloth of hemp, flax, cotton, and similar weave used for tents, sails, and other applications. The canvas material used in making the present invention ranges between 10 and 24 ounces in weight and strength. In the preferred embodiment, the weight of the canvas material is approximately 18 ounces. In a preferred embodiment of the present invention, the inner pad is formed of duck material. The term "duck" material means a plain-weave cotton fabric often used for making tents, clothing, bags, and similar items and available in various weights. The duck material used in making the present invention ranges between 6 and 18 ounces in weight and strength. In the preferred embodiment, the weight of the duck material is preferably 10 ounces.

The one or more panels of the present invention also may include one or more sheets constructed of metalized material such as cloth, paper, cardboard and other material that has been coated on the side closest to sources of potential limb injuries with one or more layers of metal.

In a preferred embodiment of the present invention, the outer sheet provides protection from limb injuries. The outer sheet also contributes to providing the present invention with a substantially stable configuration during use. The outer sheet contributes to the present invention not falling, drooping, or sagging when installed on a limb without requiring use of additional components or elements to retain a substantially stable configuration.

The inner pad contributes to the protection afforded by the present invention against limb injuries. The inner pad also provides comfort and additional protection from limb injuries. The inner pad also contributes to the overall flexible rigidity of the apparatus for protecting a limb of a user, providing an apparatus that maintains a substantially stable configuration when worn and used by the user.

Each of the two or more panels is shaped to have a lower edge, an upper edge, and opposed side edges. For an embodiment of the invention used on a limb such as an arm or leg, the "lower" edge is substantially in contact with a wrist or ankle of a user, and the "upper edge" is substantially in contact with biceps and triceps, or with quadriceps, respectively. On connecting the two or more panels to form the apparatus, the lower edge of each of the two or more panels define a circumferential lower opening in the apparatus through which, respectively, a wrist or ankle protrudes. The lower circumferential opening is dimensionally smaller than the upper circumferential opening formed on assembly of the two or more panels. The differences in size of the lower and upper circumferential openings contribute to the anthropometric shape and configuration of the present invention.

The opposed side edges of the two or more panels are connected to form the present invention. Connection may be achieved by any number of methods known to those skilled in the art. For example, but not of limitation, the opposed edges of the two or more panels may be connected by sewing. The opposed edges of the two or more panels also may be connected by electronic welding or by gluing.

The present invention also may be formed with an exterior surface and an interior surface. To help secure an apparatus for protecting a limb of a user more tightly around a portion of a limb, a strap may be attached to the exterior surface of the first panel adjacent the lower edge of the first panel. Further, any number of devices well known in the art may be used to attach the strap attached to the exterior surface of the first panel to outer edge of the second panel. For example, but not of limitation, a Velcro® element may be attached to the exterior surface of the second panel adjacent the lower edge of the second panel for securing the lower edges of the panels to the limb of a user with a Velcro® clement on the strap.

The foregoing has outlined broadly the more important features of the invention to better understand the detailed description which follows, and to better understand the contribution of the present invention to the art. Before explaining at least one embodiment of the invention in detail, it is to be understood that the invention is not limited in application to the details of construction, and to the arrangements of the components, provided in the following description or drawing figures. The invention is capable of other embodiments, and of being practiced and carried out in various ways. Also, the phraseology and terminology employed in this disclosure are for purpose of descriptions and should not be regarded as limiting.

As those skilled in the art will appreciate, the conception on which this disclosure is based may be readily used as a basis for designing other structures, cooperations of structure, methods, and systems for carrying out the purposes of the present invention. The claims, therefore, include such equivalent constructions to the extent the equivalent constructions do not depart from the spirit and scope of the present invention.

The abstract associated with this disclosure is neither intended to define the invention, which is measured by the claims, nor intended to be limiting as to the scope of the invention in any way.

The novel features of this invention, and the invention itself, both as to structure and operation, are best understood from the accompanying drawing, considered in connection with the accompanying description of the drawing, in which similar reference characters refer to similar parts, and in which:

DESCRIPTION OF THE PREFERRED EMBODIMENTS

Figure 1:
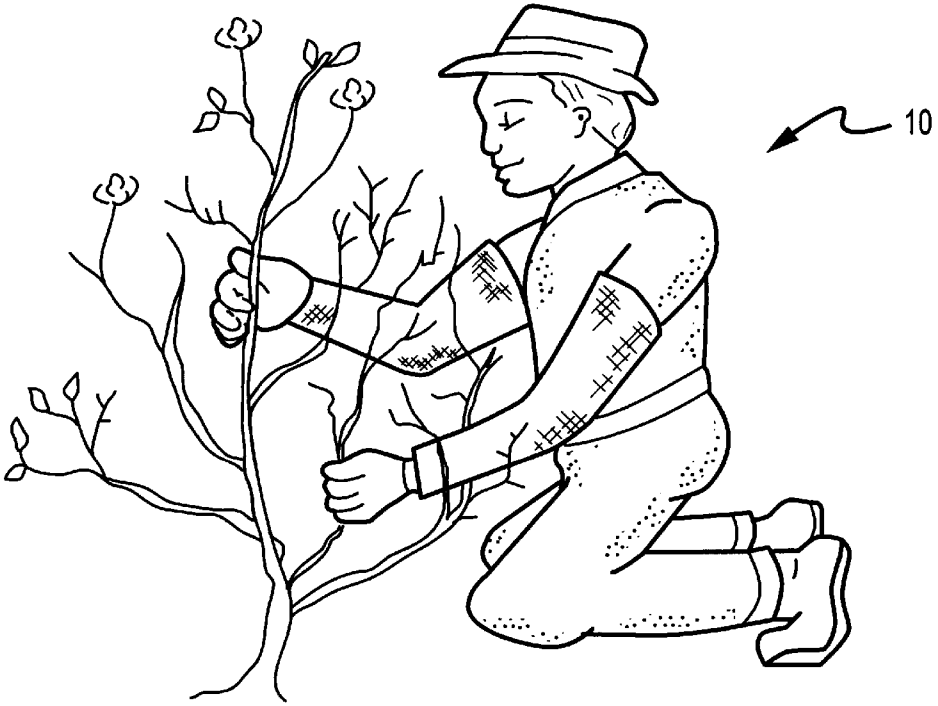
FIG. 1 is a perspective view of an apparatus for protecting a limb of a user, shown in an operative environment.
Figure 2:
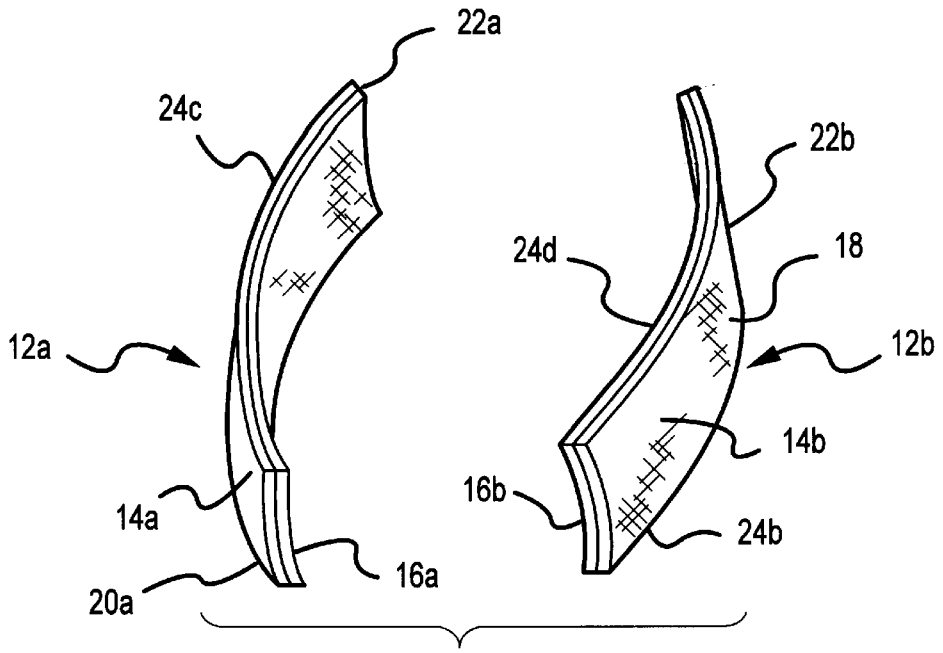
FIG. 2 perspective view of the two or more panels.

Referring initially to FIG. 1, an apparatus for protecting a limb of a user is shown and generally designated 10. As shown most clearly in FIGS. 2 and 3, apparatus 10 includes two or more anthropometrically formed panels 12*a,b*. Each of the two or more panels 12*a* and 12*b* is formed of one or more outer sheets 14*a* and 14*b* as shown in FIG. 2. Outer sheets 14*a* and 14*b* are selected in part for the ability of outer sheets 14*a* and 14*b* to protect against limb injuries and to hold shape and maintain a substantially stable configuration when installed on the limb of a user without the need for any other components, elements or structural enhancements to assist in maintaining the substantially stable configuration.

Figure 3:
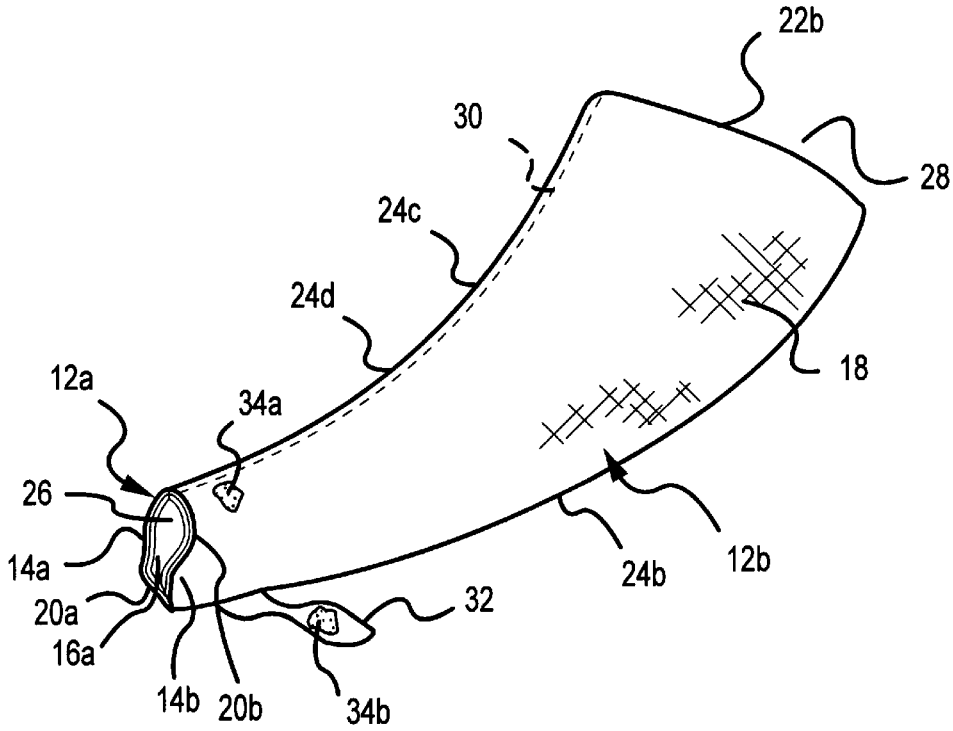
FIG. 3 is a perspective view of an apparatus for protecting a limb of a user.

As shown by cross-reference between FIGS. 2 and 3, in a preferred embodiment of apparatus 10 according to the present invention, each of the two or more panels 12*a* and 12*b* is formed of outer sheet 14*a* and 14*b*, and an inner pad 16*a* and 16*b*. Outer sheets 14*a* and 14*b* are positioned away from the user's body in proximity to anything that might cause a limb injury to the user. Inner pads 16*a* and 16*b* are formed from material providing a cushion-like mass of material softer than the material used for sheets 14*a* and 14*b*, for both comfort and protection of the user from limb injuries.

In a preferred embodiment of the present invention, outer sheets 14*a* and 14*b* are formed of a canvas material shown in FIGS. 2 and 3 in cross-hatch 18. Canvas material 18 used in apparatus 10 ranges between 8 and 24 ounces in weight and strength. Canvas material 18 is preferably approximately 18 ounces. In a preferred embodiment of the present invention, inner pad 16*a,b* is formed of duck material. Duck material is a plain-weave cotton fabric available in various weights. Duck material as shown in FIGS. 2 and 3 is preferably approximately 10 ounces.

Inner pad 16 contributes to the protection afforded by apparatus 10 against limb injuries. Inner pad 16 also provides for comfort to the user of apparatus 10. Inner pad 16 also contributes to the anthropometric shape retention of apparatus 10 when worn and used by the user.

As further shown by cross-reference between FIGS. 2 and 3, two or more panels 12 are shaped to have a lower edge 20*a,b*, an upper edge 22*a,b*, and opposed side edges 24*a,b,c,d*. Lower edges 20*a,b* are shorter than upper edged 22*a,b*. For an embodiment of the invention used on a limb such as an arm or leg, lower edges 20*a,b* are substantially in contact with a wrist or ankle of a user, and upper edge 22*a,b* is substantially in contact with biceps and triceps, or with quadriceps, respectively. As shown best in FIG. 3, following connection of panel 12*a* and panel 12*b* to form apparatus 10, lower edge 20 of each of two or more panels 12*a,b* defines a substantially circumferential lower opening 26 in apparatus 10 through which, respectively, a wrist or ankle protrudes. Following connection of panel 12*a* and panel 12*b* to form apparatus 10, upper edge 22 of each of two or more panels 12 define a substantially circumferential upper opening 28 (not shown) in apparatus 10 through which, respectively, an upper arm or leg of a user may protrude. Lower circumferential opening 26 is dimensionally smaller than upper circumferential opening 28, contributing to the anthropometric shape and configuration of the present invention.

Opposed side edges 24*a,b,c,d* of two or more panels 12, as shown in FIG. 3, are connected to form apparatus 10. Connection may be achieved by any number of methods known to those skilled in the art. For example, but not of limitation, opposed side edges 24*a,b,c,d* of two or more panels 12 may be connected by sewing or stitching. Opposed edges 24*a,b,c,d* of two or more panels 12 also may be connected by electronic welding or glue. Outer sheet 14*a* having lower edge 20*a*, upper edge 22*a*, opposed side edges 24*a* and 24*c* is placed adjacent inner pad 16*a*. Outer sheet 14*b* having lower edge 20*b*, upper edge 22*b*, opposed side edge 24*c*, and opposed side edges 24*b* and 24*d* are placed adjacent to inner pad 16*b*. Outer sheet 14*a* and inner pad 16*a* are connected to outer sheet 14*b* and inner pad 16*b* by connecting opposed side edge 24*a* to opposed side edge 24*b*, and by connecting opposed side edge 24*c* to opposed side edge 24*d*. Connection may be achieved by any number of methods known to those skilled in the art including but not limited to sewing, as shown by dotted lines 30 on FIG. 3.

As further shown in FIG. 3, to secure apparatus 10 more tightly around a limb to be protected, as best shown in FIG. 1, a strap 32 may be attached to outer sheet 14*a* of panel 12*a* adjacent to lower edge 20*a*. Further, any number of devices well known in the art may be used to attach strap 32 to outer sheet 14*a* of panel 12*a*, including but not limited to sewing. A Velcro® element 34 which may be attached to outer sheet 14*b* of panel 12*b* adjacent to lower edge 20*b* and to strap 32 to secure apparatus 10 to a limb of a user.

Figure 4:
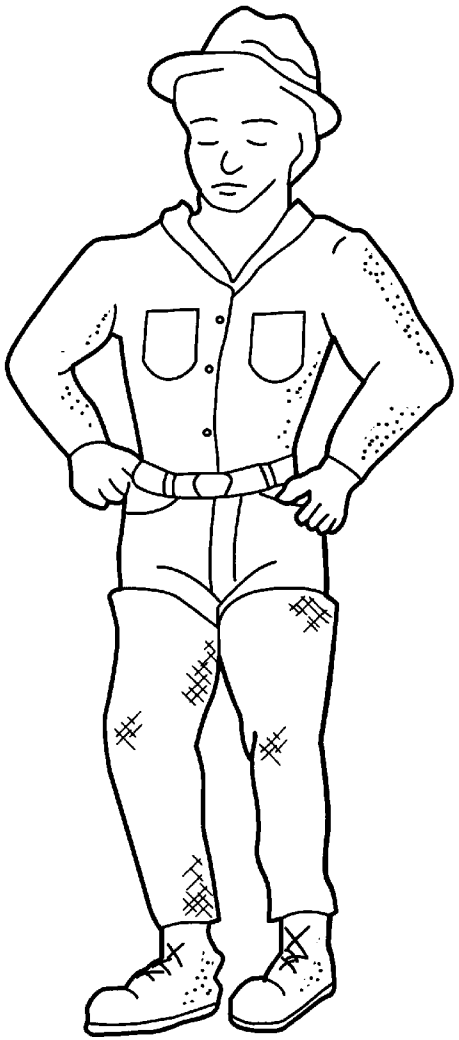
FIG. 4 is a perspective view of an alternative embodiment of an apparatus for protecting a limb of a user.

As shown in FIG. 3, a preferred embodiment of apparatus 10 for protecting a limb of a user is anthropometrically formed to protect an arm of a user. Yet another embodiment of apparatus 10 according to the present invention is formed to protect a leg of a user, as shown in FIG. 4.

While the apparatus for protecting a limb of a user shown in the accompanying drawing figures includes at least one embodiment of the present invention, it is merely one embodiment of the invention, is not intended to be exclusive, and is not a limitation of the present invention.

The apparatus for protecting a limb of a user as shown and disclosed in detail in this instrument is fully capable of obtaining the objects and providing the advantages stated, this disclosure is merely illustrative of the presently preferred embodiments of the invention, and no limitations are intended in connection with the details of construction, design or composition other than as provided and described in the appended claims.

What is claimed is:

1. An apparatus for protecting the arm of a user, comprising:

at least two anthropometrically formed panels having an outer sheet formed of canvas and an inner pad formed of cotton duck coextensive with the outer sheet; and means for connecting the at least two panels to form the apparatus.

2. An apparatus for protecting the arm of a user as defined in claim 1, wherein the connecting means is sewing.

3. An apparatus for protecting the arm of a user, comprising:

at least two panels having an outer sheet formed of canvas or metalized material and an inner pad coextensive with the outer sheet, and wherein the at least two panels has a lower edge, an upper edge, and opposed side edges; and means for connecting the opposed side edges of the panels by electronic welding to form a substantially stable configuration of the apparatus.

4. An apparatus for protecting an arm of a user as defined in claim 3, wherein the lower edge of each of the at least two panels is shorter than the upper edge of the two or more panels.

5. An apparatus for protecting an arm of a user as defined in claim 3, wherein the apparatus is a substantially stable configuration.

6. An apparatus for protecting an arm of a user as defined in claim 3, wherein the attaching means is electronic welding.

7. A method for protecting the arm of a user, comprising the steps of:

selecting one or more sheets;

forming the sheets into at least two antropometrically shaped panels having an outer sheet of canvas and an inner pad of duck material coextensive with the outer sheet, and wherein the at least two panels has a lower edge, upper edge and opposing side edges; and connecting the opposing side of the at least two panels by sewing or electronic welding to form the apparatus.

8. A method for protecting an arm of a user as defined in claim 7, wherein the selecting step includes selecting one or more sheets having the capability of forming at least two anthropometrically shaped panels.

9. A method for protecting an arm of a user as defined in claim 7, wherein the connecting step further comprises sewing.

10. A method for protecting an arm of a user as defined in claim 7, wherein the connecting step further comprises electronic welding.

* * * * *